US011128055B2

(12) United States Patent
Hojjat et al.

(10) Patent No.: US 11,128,055 B2
(45) Date of Patent: Sep. 21, 2021

(54) DUAL DIPOLE OMNIDIRECTIONAL ANTENNA

(71) Applicant: Communication Components Antenna Inc., Kanata (CA)

(72) Inventors: Nasrin Hojjat, Kanata (CA); Sadegh Farzaneh, Kanata (CA); Minya Gavrilovic, Kanata (CA); Des Bromley, Kanata (CA); Parna Kazerani, Kanata (CA)

(73) Assignee: Communication Components Antenna Inc., Kanata (CA)

( * ) Notice: Subject to any disclaimer, the term of this patent is extended or adjusted under 35 U.S.C. 154(b) by 0 days.

(21) Appl. No.: 15/609,448

(22) Filed: May 31, 2017

(65) Prior Publication Data

US 2017/0358870 A1 Dec. 14, 2017

Related U.S. Application Data

(60) Provisional application No. 62/349,846, filed on Jun. 14, 2016.

(51) Int. Cl.

| | |
|---|---|
| ***H01Q 25/00*** | (2006.01) |
| ***H01Q 21/06*** | (2006.01) |
| ***H01Q 5/48*** | (2015.01) |
| ***H01Q 9/44*** | (2006.01) |
| ***H01Q 21/28*** | (2006.01) |
| ***H01Q 21/24*** | (2006.01) |

(Continued)

(52) U.S. Cl.

CPC ..... *H01Q 21/062* (2013.01); *H01Q 5/48* (2015.01); *H01Q 9/32* (2013.01); *H01Q 9/44* (2013.01); *H01Q 21/24* (2013.01); *H01Q 21/28* (2013.01); *H01Q 25/001* (2013.01); *H01Q 9/16* (2013.01)

(58) Field of Classification Search

CPC H01Q 9/065; H01Q 5/48; H01Q 9/44; H01Q 21/28

See application file for complete search history.

(56) References Cited

U.S. PATENT DOCUMENTS 4,434,425 A * 2/1984 Barbano ..... H01Q 19/17 343/797

5,767,809 A 8/1998 Bosse (Continued)

OTHER PUBLICATIONS

Quan, Xu Lin, et al. "Development of a broadband horizontally polarized omnidirectional planar antenna and its array for base stations." Progress in Electromagnetics Research 128 (2012): 441-456.

*Primary Examiner* — Ab Salam Alkassim, Jr.
(74) *Attorney, Agent, or Firm* — Ipsilon USA, LLP

(57) ABSTRACT

Systems and devices relating to antennas and antenna systems. A horizontal omnidirectional antenna has two dipoles with each dipole being in a V-configuration such that the arms of the dipole define an angle. The two dipoles are arranged so that the angles defined by each of the dipoles face and open toward each other. The horizontal omnidirectional antenna can be configured to operate with specific frequency bands. By nesting two instances of this antenna, with one configured for high band frequencies and one configured for low band frequencies, a dualband omnidirectional antenna can be obtained. The resulting antenna is physically compact and can be used in small MIMO systems along with vertical omnidirectional antennas.

19 Claims, 20 Drawing Sheets

(51) Int. Cl.
*H01Q 9/32* (2006.01)
*H01Q 9/16* (2006.01)

(56) References Cited

U.S. PATENT DOCUMENTS 5,936,590 A * 8/1999 Funder ..... H01Q 21/062 343/789
5,940,044 A * 8/1999 Smith ..... H01Q 1/246 343/794
6,025,798 A * 2/2000 Colombel ..... H01Q 1/523 342/361
6,201,510 B1 * 3/2001 Lopez ..... H01Q 9/16 343/797
6,333,720 B1 * 12/2001 Gotti ..... H01Q 1/246 343/797
6,339,407 B1 * 1/2002 Gabriel ..... H01Q 1/246 343/797
6,498,589 B1 * 12/2002 Horii
6,650,301 B1 * 11/2003 Zimmerman ..... H01Q 1/246 343/803
6,734,829 B1 * 5/2004 Gotti ..... H01Q 1/523 343/797
6,822,618 B2 * 11/2004 Bisiules ..... H01P 5/103 343/793
6,985,123 B2 * 1/2006 Gotti ..... H01Q 21/24 343/700 MS
7,405,710 B2 * 7/2008 Bisiules ..... H01P 5/103 343/797
7,579,999 B2 * 8/2009 Boβ ..... H01Q 9/06 343/795
7,688,271 B2 * 3/2010 Cao ..... H01Q 9/28 343/797
8,060,167 B2 * 11/2011 Saitou ..... H01Q 9/16 455/575.7
8,199,063 B2 * 6/2012 Moon ..... H01Q 1/246 343/793
8,760,356 B2 * 6/2014 Bu et al.
8,779,998 B1 7/2014 Pickles
9,287,617 B2 * 3/2016 Kokkinos ..... H01Q 1/523
9,385,432 B2 * 7/2016 Shi et al.
9,837,711 B2 * 12/2017 Shtrom ..... H01Q 1/38
9,966,664 B2 * 5/2018 Katipally ..... H01Q 21/062
9,979,081 B2 * 5/2018 Berezin ..... H01Q 1/521
2004/0108956 A1 * 6/2004 Gotti ..... H01Q 1/246 343/700 MS
2004/0140942 A1 * 7/2004 Gotti ..... H01Q 13/10 343/810
2004/0222937 A1 * 11/2004 Gotti ..... H01Q 1/246 343/797
2005/0110683 A1 * 5/2005 Song ..... H01Q 1/246 343/700 MS
2005/0239519 A1 * 10/2005 Saitou ..... H01Q 3/247 455/575.1
2006/0114168 A1 * 6/2006 Gotti ..... H01Q 1/246 343/797
2007/0229385 A1 * 10/2007 Deng ..... H01Q 1/246 343/797
2007/0254587 A1 * 11/2007 Schadler ..... H01Q 1/246 455/13.3
2008/0074339 A1 * 3/2008 Lee ..... H01Q 9/26 343/803
2008/0111757 A1 * 5/2008 Bisiules ..... H01P 5/103 343/799
2009/0278759 A1 * 11/2009 Moon ..... H01Q 1/246 343/810
2010/0009638 A1 * 1/2010 Saito ..... H01Q 1/2258 455/73
2010/0141530 A1 * 6/2010 McMAHON ..... H01Q 1/246 342/417
2010/0201593 A1 * 8/2010 Jonsson ..... H01Q 1/246 343/824
2010/0309084 A1 * 12/2010 Bu ..... H01Q 21/08 343/824
2011/0175782 A1 * 7/2011 Choi ..... H01Q 1/246 343/798
2012/0146872 A1 * 6/2012 Chainon ..... H01Q 1/523 343/818
2013/0187822 A1 * 7/2013 Shi ..... H01Q 1/246 343/821
2013/0271336 A1 * 10/2013 Piet ..... H01Q 1/246 343/796
2014/0022131 A1 * 1/2014 Azulay ..... H01Q 1/007 343/727
2014/0091976 A1 * 4/2014 Carlson ..... H01Q 9/28 343/795
2014/0125539 A1 * 5/2014 Katipally ..... H01Q 21/062 343/794
2014/0210680 A1 * 7/2014 Stoytchev ..... H01Q 9/26 343/806
2015/0214634 A1 * 7/2015 Lee ..... H01Q 9/065 343/797
2016/0248166 A1 * 8/2016 Moon ..... H01Q 19/10
2017/0352961 A1 * 12/2017 Morrison ..... H01Q 9/0464

* cited by examiner

Radiation Pattern 1
-40
-30
-20
-10
0
90
60
30
0
-30
-60
-90
-120
-150
180
150
120
90
60
30
0
-30
-60
-90
-120
-150
180
150
120
90
60
30
0
-30
-60
-90
-120
-150
180
150
120

DUAL DIPOLE OMNIDIRECTIONAL ANTENNA

TECHNICAL FIELD

The present invention relates to antennas. More specifically, the present invention relates to a physically small horizontal omnidirectional antenna which can be configured for high frequency band or low frequency band applications.

BACKGROUND

The telecommunications revolution of the late 20th and early 21st century has led to a need and a demand for access to wireless services. Access to signals ranging from wireless networking signals to mobile telephone signals, there is now a call for wireless services to be available and ubiquitous as possible. While such wireless services are now possible, there is a further demand that equipment providing such services be as unobtrusive as possible. To this end, antennas which provide access to radio signals for such services are, preferably, as small and unobtrusive as possible.

Since the users accessing the wireless services may be at any angle to the antenna, a MIMO arrangement including at least a vertically polarized and a horizontally polarized omnidirectional antenna is the most logical choice for quite a few applications. Unfortunately, current horizontally polarized omnidirectional antennas are notorious for being large and bulky. Being able to provide physically small horizontally polarized omnidirectional antennas allows for a number of advantages. For one, a smaller antenna would allow for arrays with more elements and, therefore, a higher number of MIMO (multiple in, multiple out) data streams for the same amount of physical array area.

It should be noted that implementation of antennas in MIMO arrangements, which can increase the data capacity of wireless networks, is usually required for new base station antennas or access points. For indoor MIMO applications when the antenna is mounted on the ceiling, two types of omnidirectional antennas are required—one which includes a horizontal polarized antenna and another which includes a vertical polarized antenna. For clarity, one antenna needs to have its electrical field in the θ direction (usually referred to as a vertical omnidirectional antenna) and the other antenna needs to have its electrical field in the Φ direction (usually referred to as a horizontal omnidirectional). A vertically polarized omnidirectional antenna is easily achievable by using a monopole. However, producing a horizontally polarized omnidirectional pattern based on the duality theorem requires a uniform current loop. A uniform loop of current is only achievable when the dimensions of the loop are very small compared to the signal wavelength. Such an antenna would have a very low efficiency and cannot be used for indoor access points. Conversely, loops with a larger radius cannot provide the required uniform current distribution around the loops since the current will change its direction after a half wavelength of signal.

To provide the required uniform current distribution, different approaches have been used in literature including an antenna using four dipoles with each being fed with proper phase and amplitude to provide the required current distribution. Another approach is the Alford loop (and its derivatives). Unfortunately, the Alford loop requires special feeding approaches and is only suitable for certain technologies.

Other current technologies for omnidirectional antennas have the drawback of high circuit complexity required for MIMO feeds. Another drawback is the requirement for a large physical area for the antenna array as each omnidirectional antenna can be physically large. FIGS. 1A and 1B illustrate two previous attempts at a horizontally polarized omnidirectional antenna. FIG. 1A shows an Alford loop strip antenna from U.S. Pat. No. 5,767,809. FIG. 1B shows an omnidirectional planar antenna (see DEVELOPMENT OF A BROADBAND HORIZONTALLY POLARIZED OMNIDIRECTIONAL PLANAR ANTENNA AND ITS ARRAY FOR BASE STATIONS X. L. Quan, R. L. Li*, J. Y. Wang, and Y. H. Cui School of Electronic and Information Engineering, South China University of Technology, Guangzhou 510641, China, Progress In Electromagnetics Research, Vol. 128, 441-456, 2012).

There is therefore a need for systems and devices which mitigate if not overcome the shortcomings of the prior art.

SUMMARY

The present invention provides systems and devices relating to antennas and antenna systems. A horizontally polarized omnidirectional antenna has two dipoles with each dipole being in a V-configuration such that the arms of the dipole define an angle. The two dipoles are arranged so that the angles defined by each of the dipoles face and open toward each other. The omnidirectional antenna can be configured to operate with specific frequency bands. By nesting two instances of this antenna, with one configured for high band frequencies and one configured for low band frequencies, a dualband omnidirectional antenna can be obtained.

In a first aspect, the present invention provides an antenna comprising:

- a first dipole having a first arm extending outwardly from a first center of said first dipole and a second arm extending outwardly from said first center;
- a second dipole having a third arm extending outwardly from a second center of said second dipole and a fourth arm extending outwardly for said second center;

wherein

- said first arm and said second arm define a first angle with a first opening and with said first center being a first vertex of said first angle;
- said third arm and said fourth arm define a second angle with a second opening and with said second center being a second vertex of said second angle;
- said first and second dipoles being constructed and arranged such that said first opening and said second opening face each other;
- said antenna is a horizontally polarized omnidirectional antenna.

In a second aspect, the present invention provides an antenna comprising:

- two assemblies for use as antenna elements, a first assembly being nested inside a second assembly, said second assembly comprising:
  - a first dipole having a first pair of arms, said first pair of arms being in a V-configuration defining a first opening;
  - a second dipole having a second pair of arms, said second pair of arms being in another V-configuration defining a second opening;

wherein

- said first opening and said second opening are facing each other;

said first assembly is located between said first opening and said second opening.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1A:
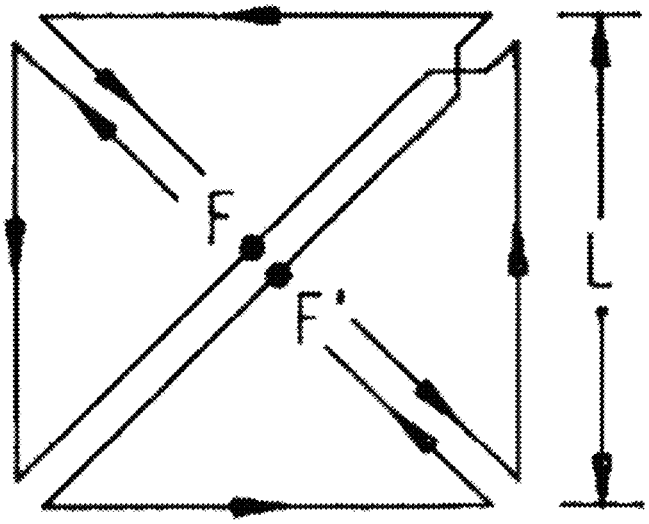
FIG. 1A (Prior Art)
FIGS. 1A and 1B illustrate examples of horizontally polarized omnidirectional antenna according to the prior art.
Figure 1B:
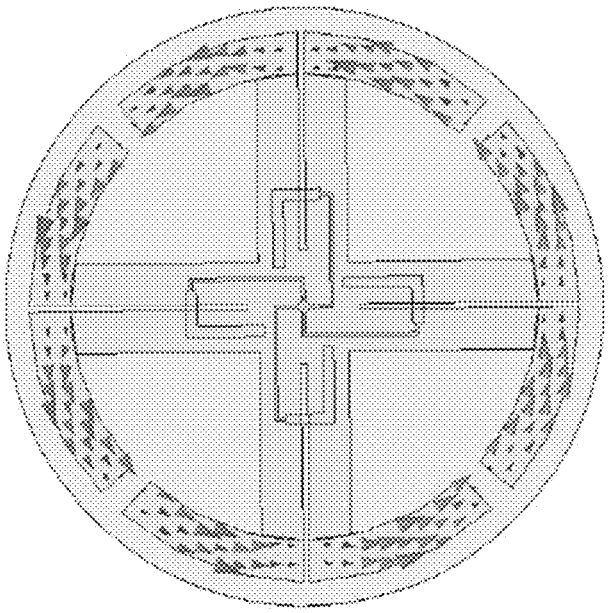
FIG. 1B (Prior Art)
Figure 2:
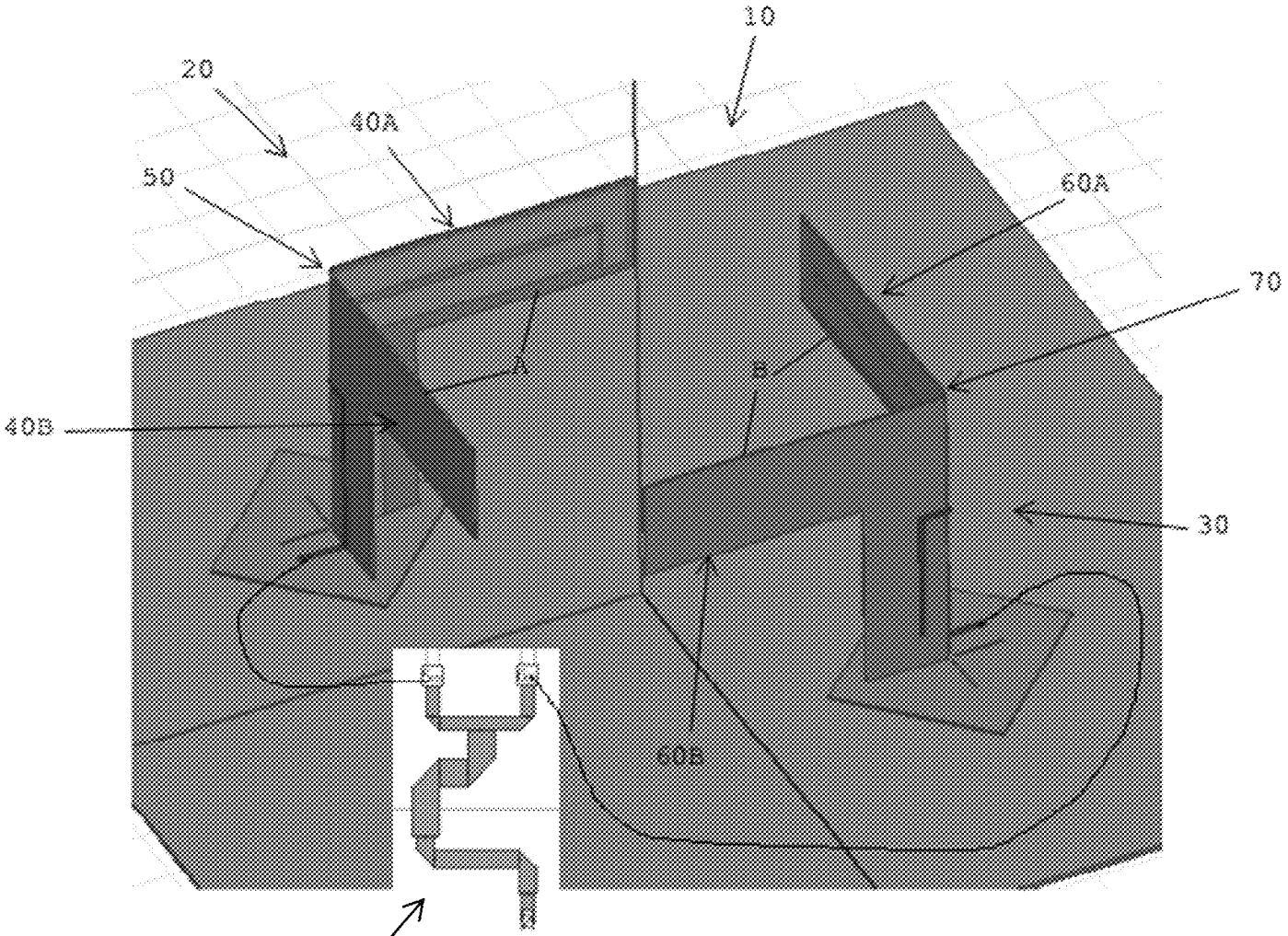
FIG. 2 illustrates one implementation of an omnidirectional antenna according to one aspect of the invention.

Referring to FIG. 2, one implementation of antenna according to one aspect of the invention is illustrated. As can be seen, the antenna 10 includes a first dipole 20 and a second dipole 30. The first dipole 20 has two arms 40A, 40B extending outwardly from a center 50. Similarly, the second dipole 30 has two arms 60A, 60B extending outwardly from a center 70. The two arms 40A, 40B define an angle A between them while arms 60A, 60B also define an angle B between them. The two dipoles 20, 30 are configured so that angles A and B are facing each other, i.e., each pair of arms open towards the other pair. It should be clear that center 50 acts as the vertex for angle A while center 70 acts as the vertex for angle B. It should be noted that FIG. 2 includes a splitter 75 used for splitting a signal between the two dipoles. As can be seen, the signal is split between the two dipoles. It should further be noted that the output cables from the splitter to the dipoles are of the same length. The length of these cables can be adjusted or replaced to adjust the resulting patterns.

Figure 3:
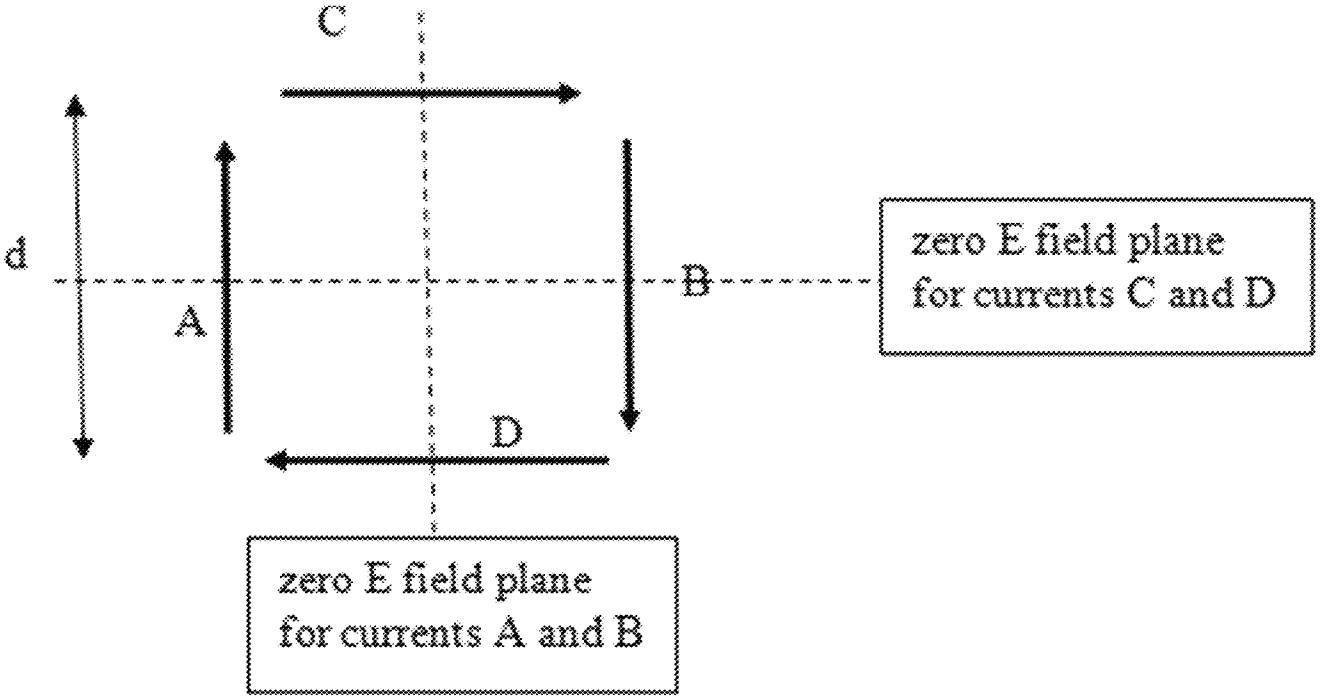
FIG. 3 is a schematic diagram for use in explaining a concept of one aspect of the invention.
Figure 4:
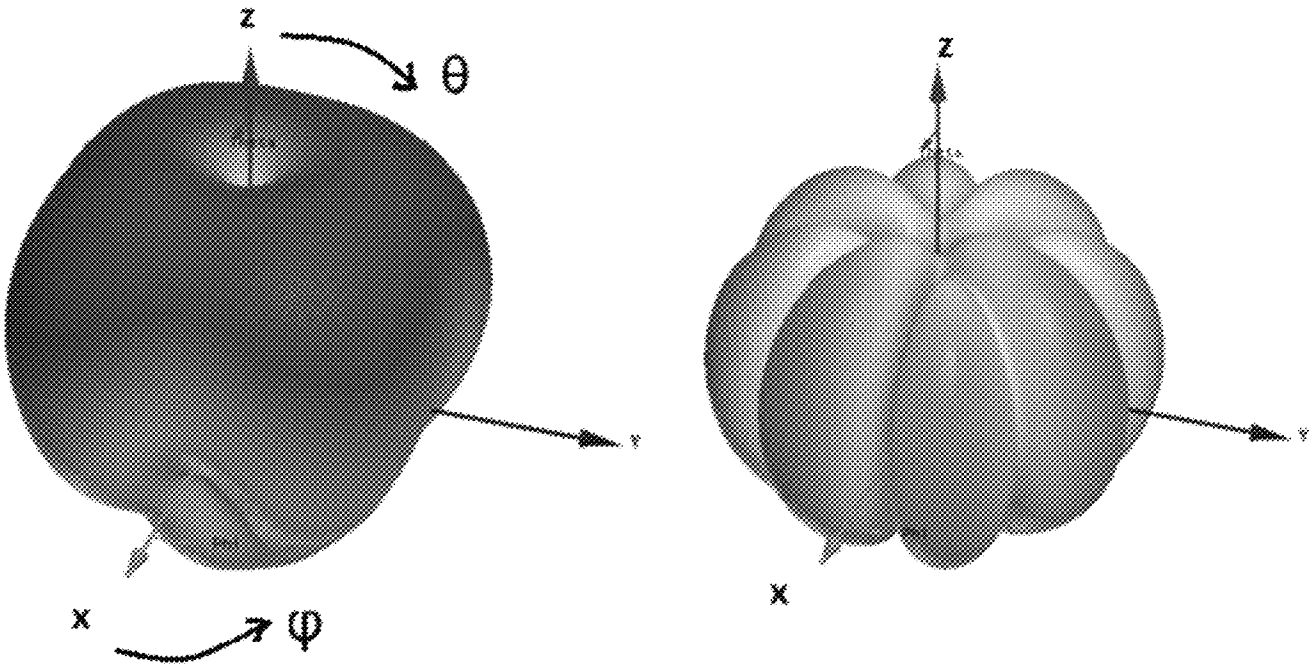
FIG. 4 illustrates one example of co-polarization and cross-polarization patterns for a horizontal omnidirectional antenna.

To explain the invention, it should be noted that if two currents with opposite directions are separated from each other by a distance d, there will always be a null in the pattern along their normal bisecting plane. This will reduce the cross polarization component in the main planes. The spacing between the currents as shown in FIG. 3 will determine the location of the maximum peak of the elevation patterns. Referring to FIG. 3, when current is travelling in the directions indicated by A, B, C and D in FIG. 3 emit an electromagnetic field, the electromagnetic pattern produced be a omnidirectional pattern with a null in the middle and an electrical field in $\Phi$ direction. This is very similar to the pattern of a vertical monopole with an electrical field in $\theta$ direction. The co-polarization and the cross-polarization patterns in 3D are shown in FIG. 4. In FIG. 4, in the $\Phi$ direction, $\Phi$ is a dependent unit vector with angle $\Phi$ measured from the x-axis while in the $\theta$ direction, $\theta$ is a dependent vector with angle $\theta$ measured from the z-axis.

Figure 5:
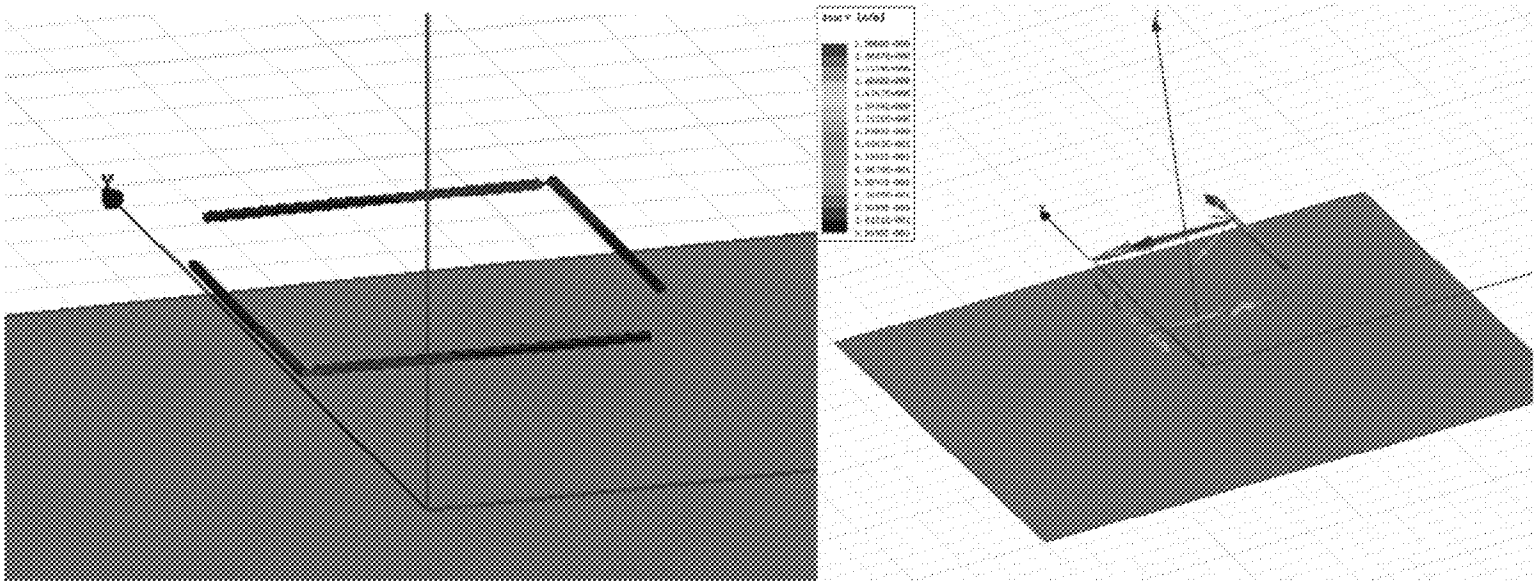
FIG. 5 shows current distributions on dipoles according to one aspect of the invention.
Figure 6:
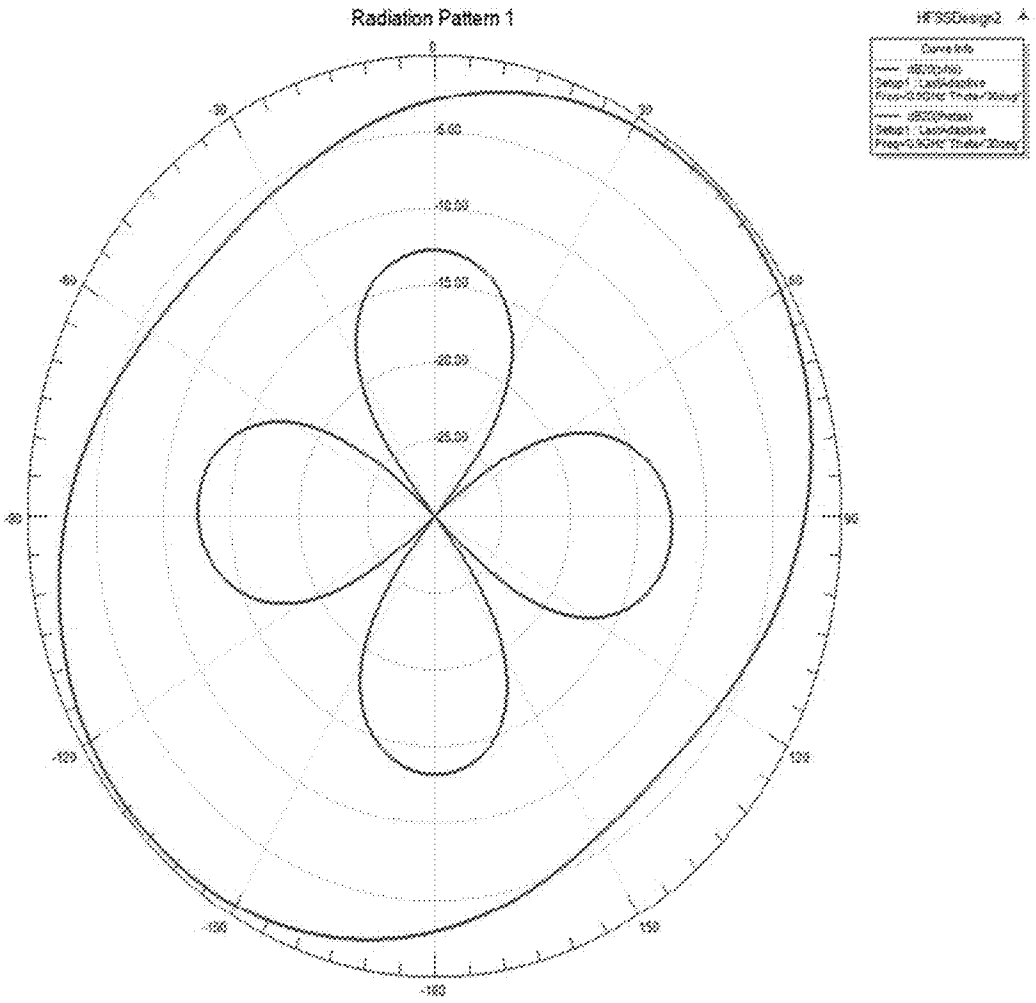
FIG. 6 is an illustration of 2D radiation patterns for a horizontal omnidirectional antenna.
Figure 7:
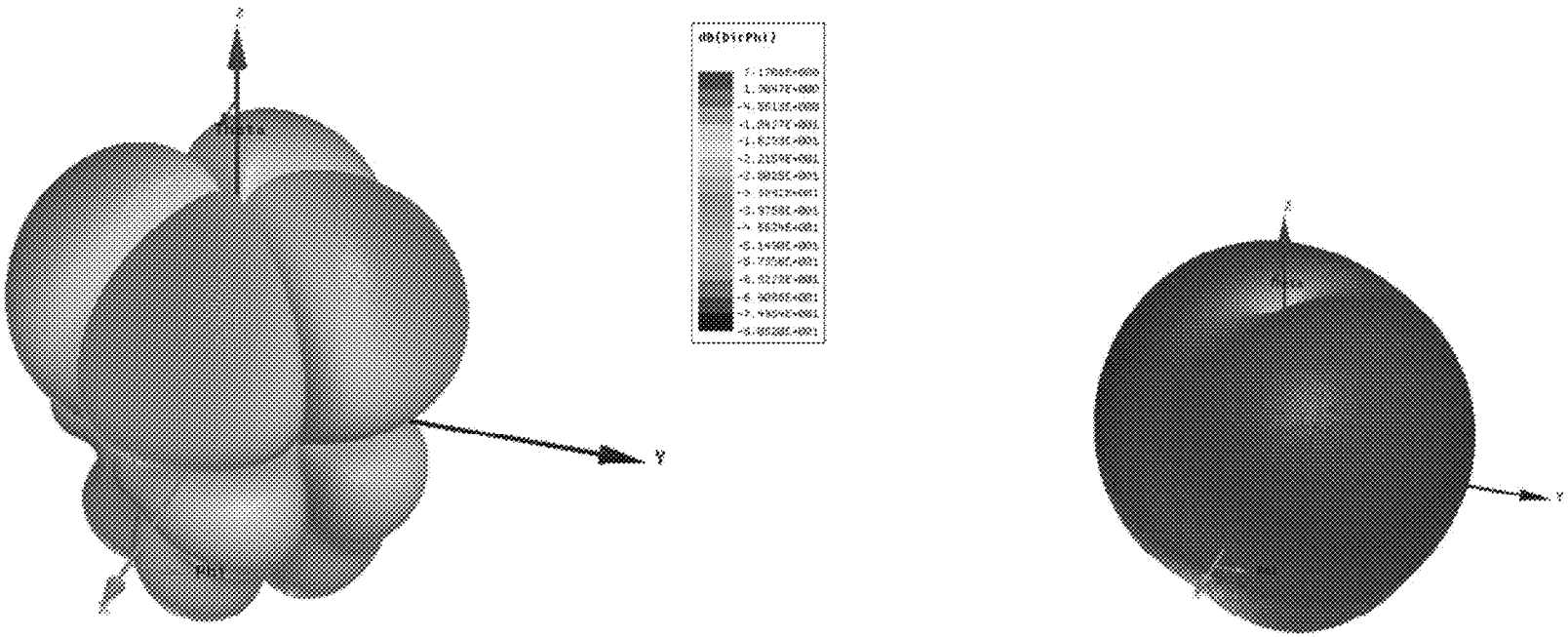
FIG. 7 shows 3D simulated radiation patterns for one implementation of the present invention.

One main challenge is in how to produce the current distribution shown in the figures. The approach taken in the present invention only requires two dipoles. Since the spacing between the two dipoles can be small, the resulting antenna can be physically small. As well, the feeding network can also be simple such as one where both dipoles are fed using, in one implementation, a 3 dB splitter (e.g. element 75 in FIG. 2) with two output cables. This approach is schematically illustrated in FIG. 5. In this approach, two dipoles, each in a V-configuration, is placed in front of one another with their openings facing each other as in the figure. By judiciously feeding each dipole with a signal from a splitter such that the current is as shown on the right side of FIG. 5, the resulting 2-D radiation pattern in FIG. 6 is achieved. A 3-D radiation pattern for the ideal version of the V-configuration horizontal omnidirectional antenna is illustrated in FIG. 7.

Figure 8:
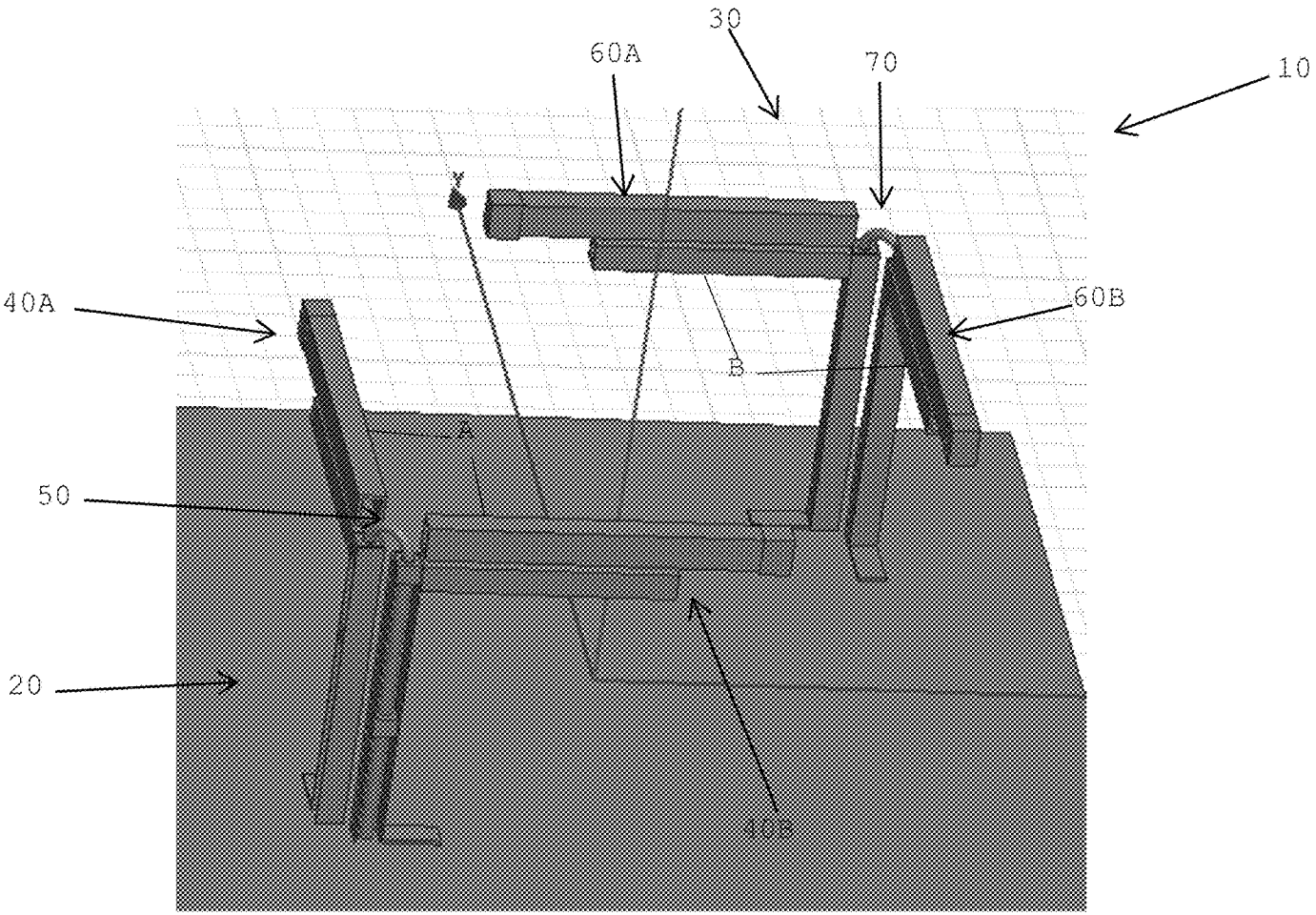
FIG. 8 is an illustration of another implementation of one aspect of the present invention.

Regarding implementation, the dual dipoles of the antenna can be implemented as illustrated in FIG. 2. In FIG. 2, the dipoles are implemented as metallic traces on a printed circuit board with each arm of each dipole extending outwardly from each dipole's respective center. In another embodiment, FIG. 8 illustrates a metallic rod or wire implementation of the present invention. As can be seen, FIG. 8 uses similar reference numbers parts similar to those in FIG. 2.

Figure 9:
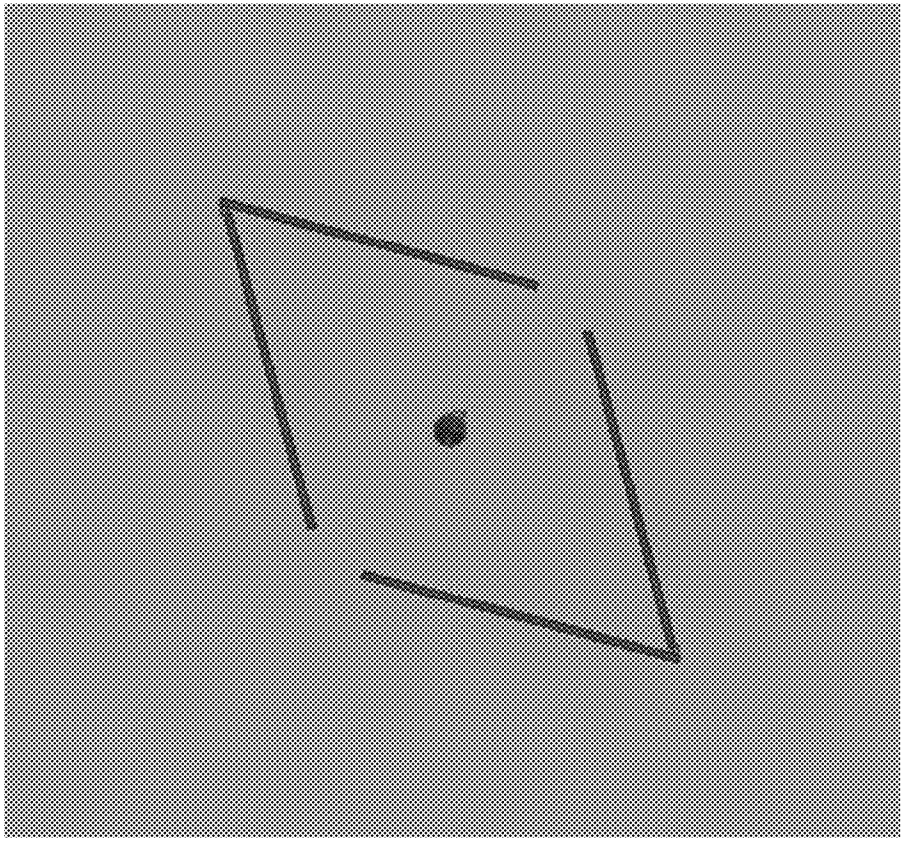
FIGS. 9 and 10 schematically illustrate variants of angle configurations which may be used with implementations of the invention.
Figure 10:
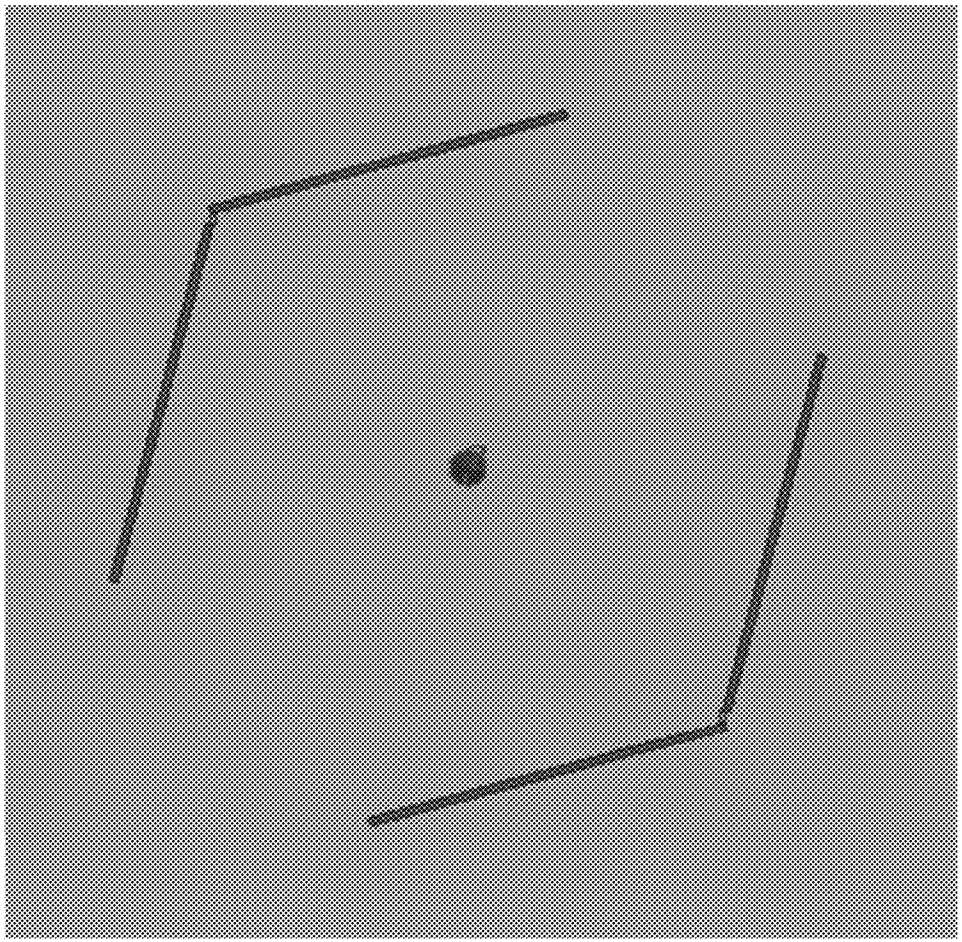
Figure 11:
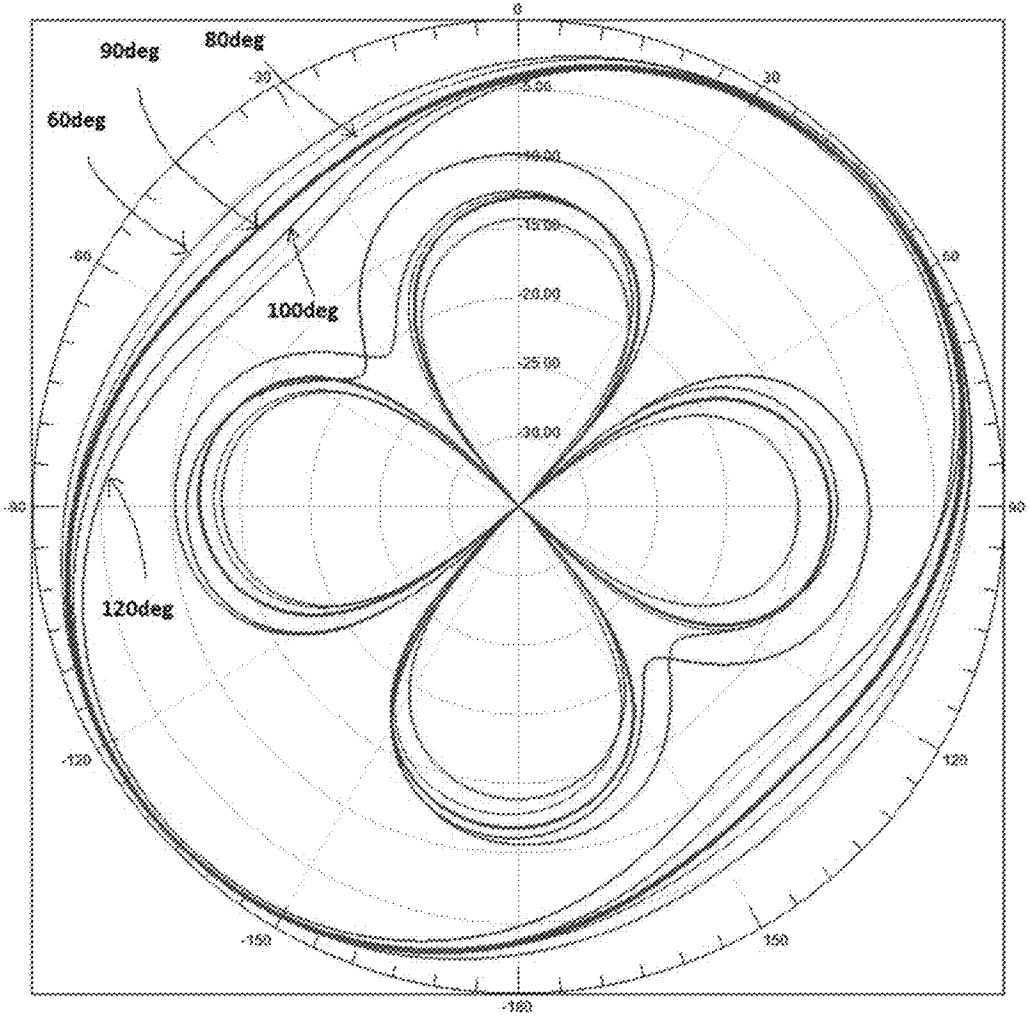
FIG. 11 shows 2D radiation patterns for differently angled dipoles used in omnidirectional antennas.
Figure 12:
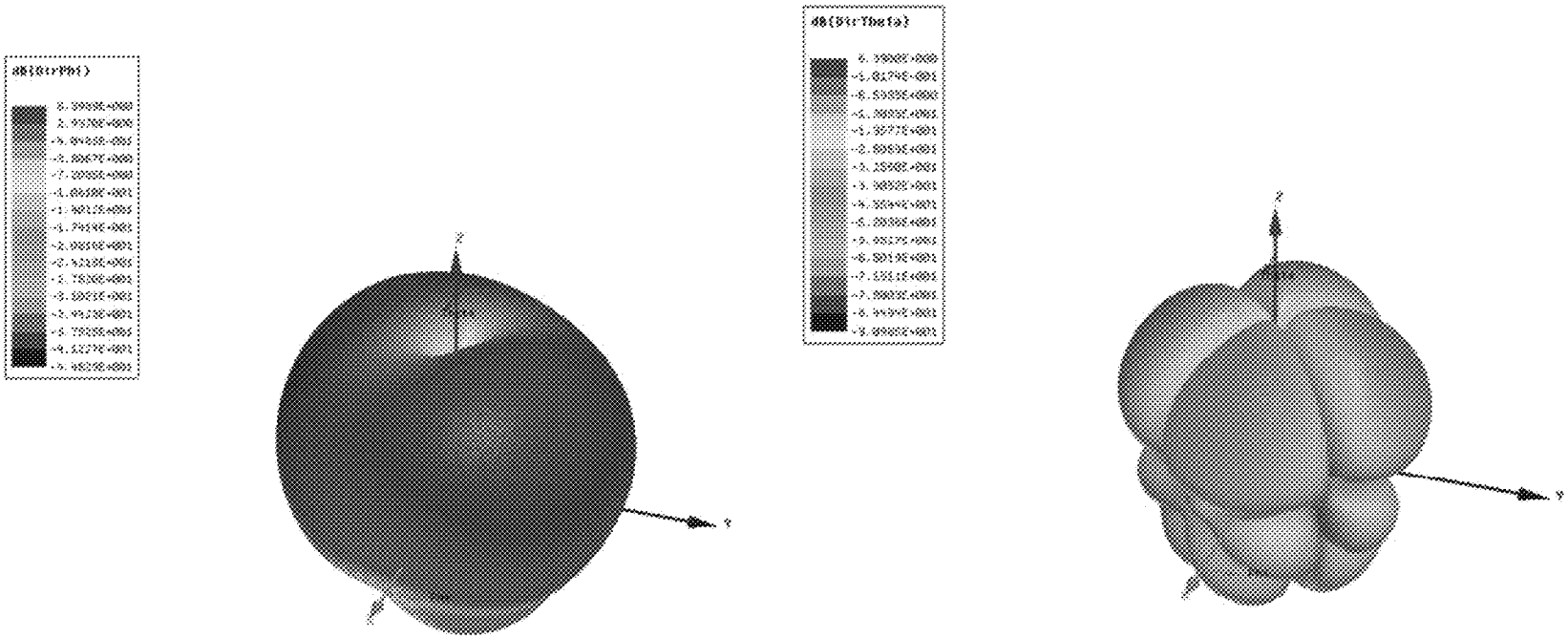
FIG. 12 are 3D radiation patterns for 60 degree dipoles used in an omnidirectional antenna according to another aspect of the invention.

In terms of variants, it should be noted that the angles A and B (as noted in FIGS. 2 and 2) may be varied. FIGS. 2 and 8 illustrate implementations where the angles A and B between the arms are both at 90 degrees. However, other angles are also possible. FIG. 9 illustrates a top down schematic view of another implementation of the invention where the angles A and B are set at 60 degrees. FIG. 10 illustrates another top down schematic view of another implementation, this time where the angles A and B are set at 120 degrees. It should be clear that the angles A and B may be considerably varied and the resulting antenna will still be useful. Experiments have shown that an angle between the arms as low as 50 degrees and as high as 120 degrees will still yield an antenna that is useful. FIG. 11 illustrates the 2D radiation pattern for various angles while FIG. 12 illustrates the 3D radiation pattern for a dual dipole antenna according to the invention where the angle between the arms is set to 60 degrees.

It should be clear that the implementations illustrated in the Figures use symmetrical dipoles as in each dipole is a mirror of the other dipole. However, this is not necessary as antennas where one dipole has a different angle from the other dipole. To clarify, if one uses the terminology used for FIG. 10, angles A and B can be different. Such an antenna would produce asymmetrical beams and may be useful for some applications.

It should also be clear that the implementations illustrated in the Figures use symmetrical dimensions for the arms. This means that the same dimensions for the arms are used for the two dipoles, i.e. dipole arm length is constant for the two dipoles. However, implementations where one dipole has one arm longer than the other are also possible. The other dipole can also have one dipole arm longer than the other, resulting in a rectangular top down outline of the dipole arms. For the symmetrical implementation illustrated in the Figures, the top down outline of the dipole arms is that of a square.

It should be noted that the resulting dual dipole antenna may be used for different frequency bands. The spacing between the two dipoles would be dependent on the frequencies (and thereby wavelengths) of the signals for which the antenna will be used. Experiments have shown that the dipoles can be separated by a distance of between 0.3 to 0.7 of a signal wavelength.

It should be clear that, as noted above, the preferred separation distance is between 0.3 to 0.7 of a signal wavelength. For a certain frequency band, implementations have used a frequency whose wavelength is approximately midway through the frequency band for the distance calculations. As an example, for a desired frequency band of between 1695 MHz-2690 MHz (or 1.695 GHz to 2.690 GHz), a middle frequency of approximately 2.2 GHz can be used. For such a middle frequency, the signal wavelength would be approximately 136 mm. Since the separation is desired to be between 0.3 to 0.7 of a signal wavelength, a separation of 0.5 (or half) of the 136 mm wavelength can be used. This results in a separation distance between the dipoles of 68 mm. With such a separation distance, and taking the extremes of the frequency band of 1.695 GHs to 2.690 GHz (i.e. of a wavelength band of from 178.7 mm to 111.4 mm), the separation distance between the two dipoles therefore ranges from 0.38 of the longest wavelength to 0.61 of the shortest wavelength in the desired frequency band. For clarity, the 68 mm fixed separation distance is equal to 0.38×178.7 mm (the longest wavelength in the desired frequency band) and to 0.61×111.44 mm (the shortest wavelength in the desired frequency band). Care should be taken when determining the separation distance between the dipoles so that, preferably, this distance remains between 0.3 to 0.7 of any wavelength in the desired frequency range. This is preferred to ensure that a proper omnidirectional pattern is produced.

In another implementation of the invention, an antenna for use with the 698-960 MHz frequency band had a separation distance of 160 mm between the two vertices of the dipoles. In another implementation, an antenna for use with the 1695-2690 MHz frequency band had a spacing of 60 mm between the two vertices of the dipoles.

For clarity, the distance between the dipoles is, in this case, measured to be the distance between the vertices of the two dipoles.

Since the antenna may be configured for different frequency bands, a dual band antenna using nested V-configured antennas can be created. A low band antenna configured for low frequencies can be created while a high frequency antenna can be placed in the space between the V-configured dipoles of the low band antenna. Such a two-port dual band antenna is illustrated in FIGS. 13 and 14.

Figure 13:
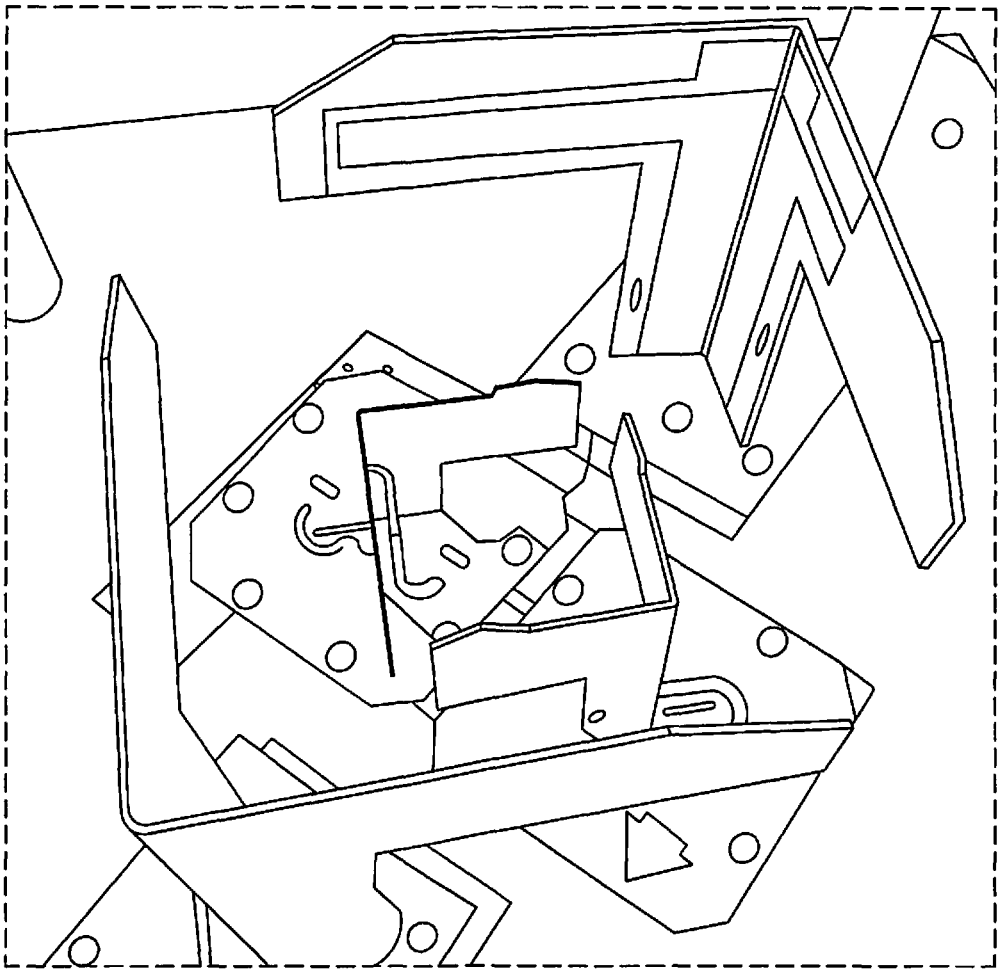
FIGS. 13 and 14 are pictures illustrating a dual band omnidirectional antenna which use two instances of an omnidirectional antenna according to another aspect of the invention.
Figure 14:
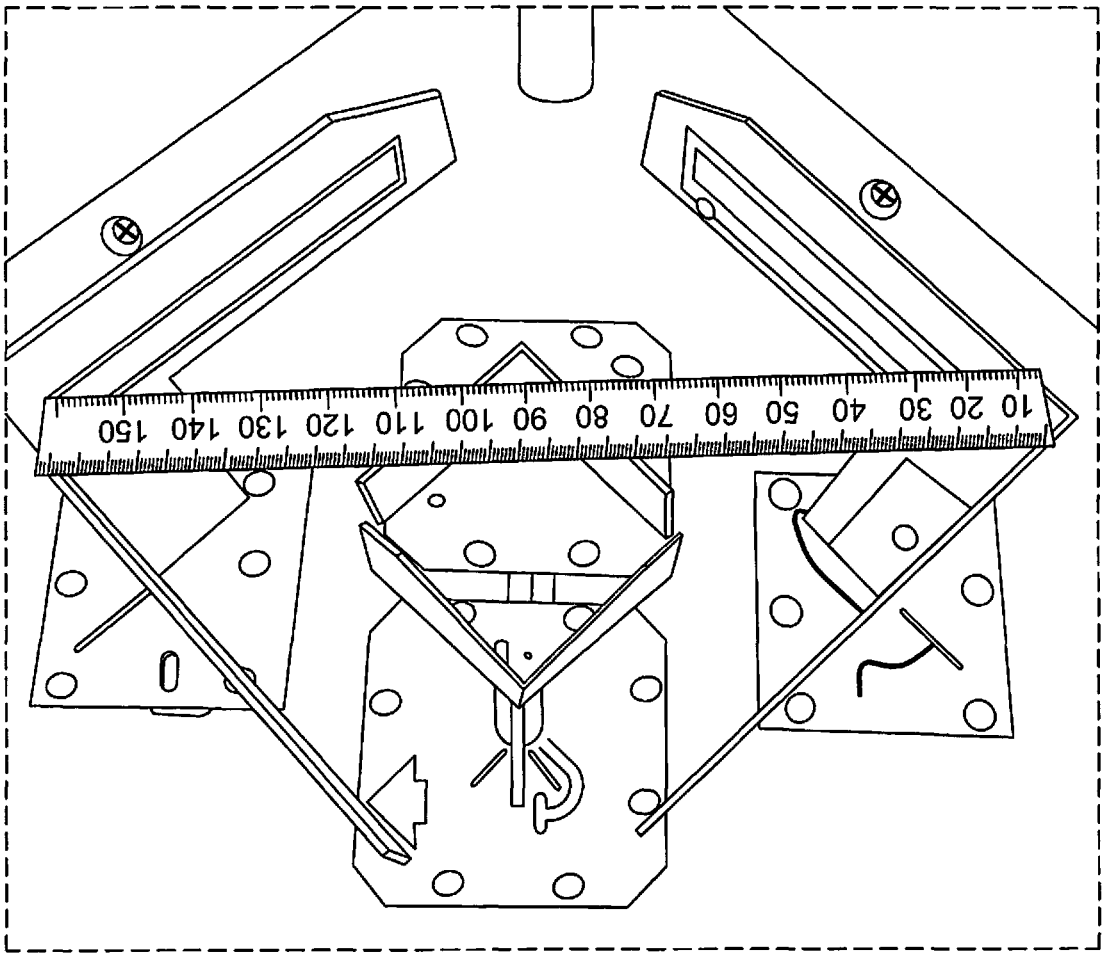

As can be seen in FIGS. 13 and 14, a first dual dipole antenna is placed in the space between two dipoles of a second dual dipole antenna. The first antenna is physically smaller than the second antenna and is configured to operate with a frequency band that is different from the frequency band for the second antenna. In one implementation, the first antenna is configured for a high band frequency range (e.g. 1710-2690 MHz) while the second antenna is configured for a low frequency band (e.g. 698-960 MHz). When the first antenna and the second antenna are combined, the resulting dual band omnidirectional antenna (fed by a diplexer) can be used in an antenna panel for use in MIMO applications.

It should be clear that, following from the example illustrated in FIG. 2, two splitters would be used for the dual band omnidirectional antenna. One splitter would be used for high band signals while a second splitter would be used for low band signals. The first splitter would feed the high band dipoles while the second splitter would feed the low band dipoles.

Figure 15:
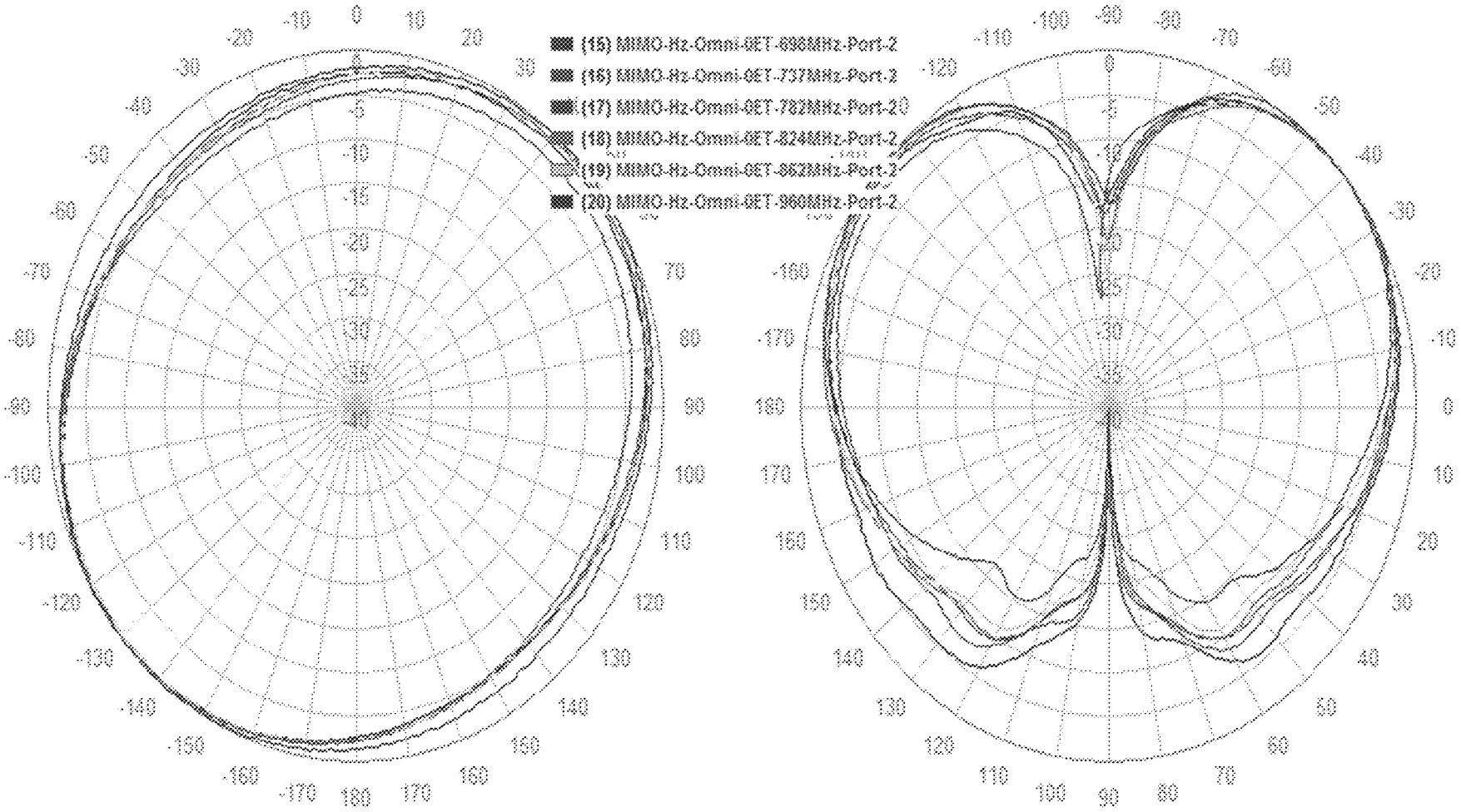
FIGS. 15, 16, and 17 show measured 2D patterns for the antennas illustrated in FIGS. 13 and 14 for three different frequency bands.
Figure 16:
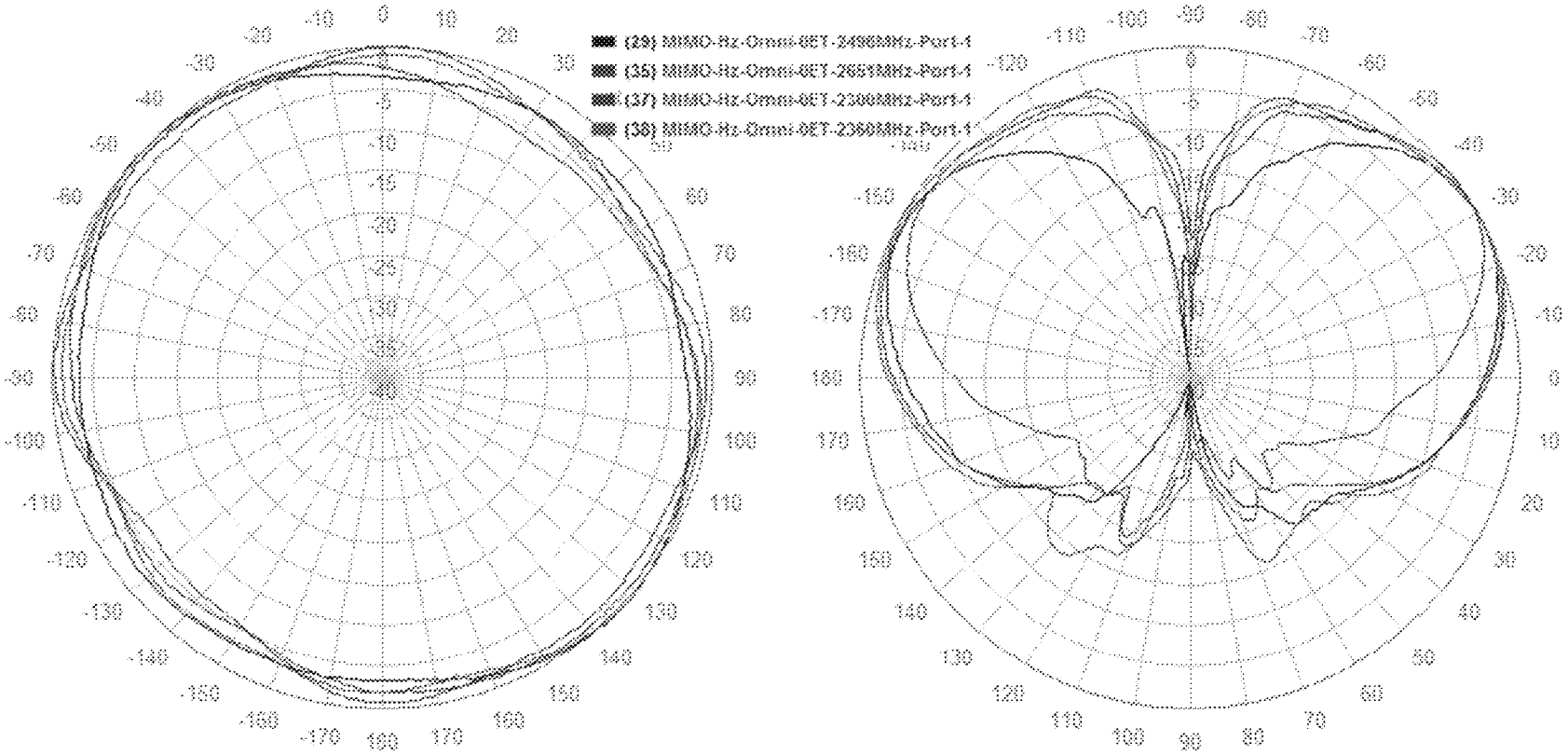
Figure 17:
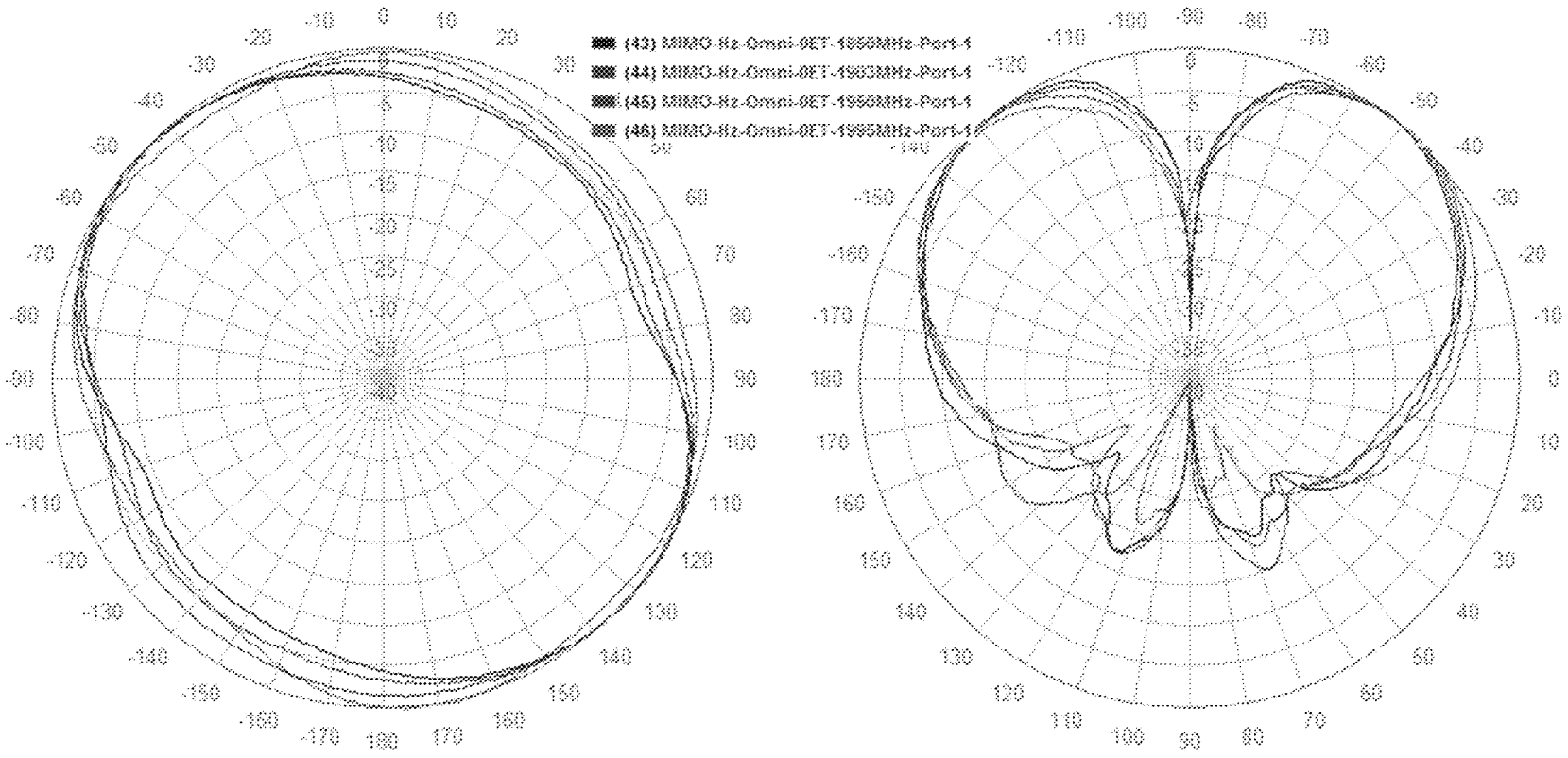
Figure 18:
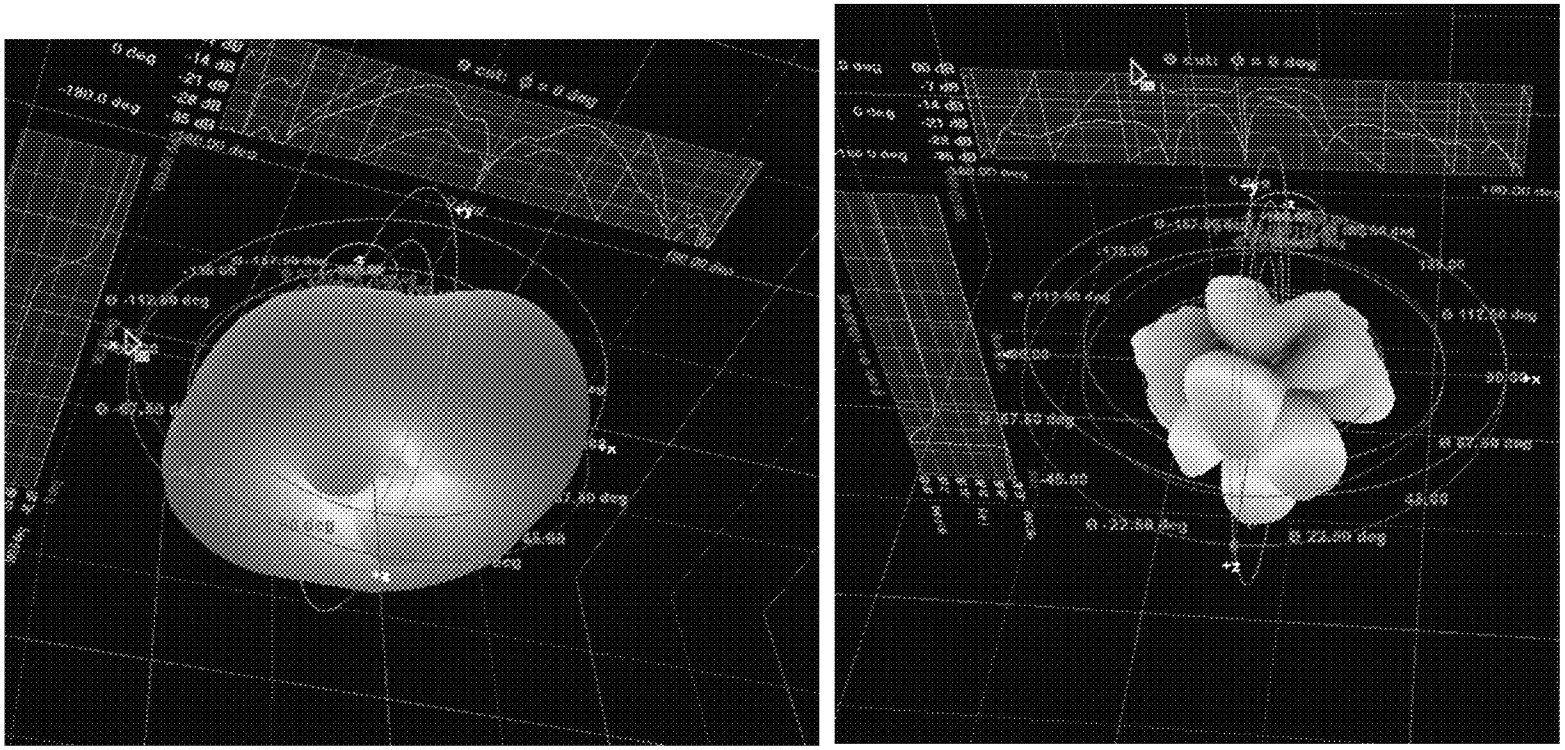
FIGS. 18 and 19 show examples of co-polarization and cross-polarization measured 3D patterns for two different frequency bands at 2496 MHz and 912 MHz.
Figure 19:
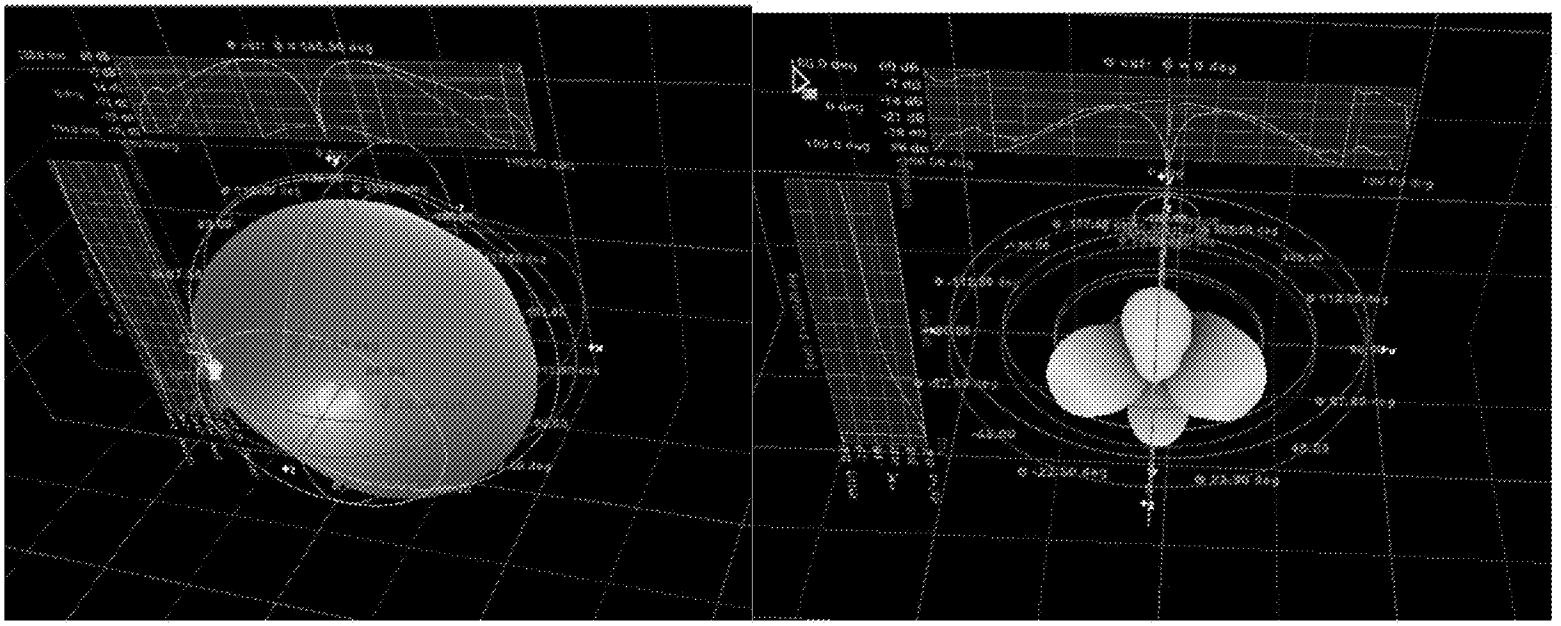

For the dual-band omnidirectional antennas in FIGS. 13 and 14, the measured 2D patterns for these antennas at three different frequency bands are presented in FIGS. 15, 16, and 17. FIG. 15 shows the measured omnidirectional patterns for the 698-960 MHz band. FIG. 16 shows the measured omnidirectional pattern for the 2.3-2.690 GHz frequency band. FIG. 17 shows the measured omnidirectional pattern for the 1.850-1995 GHz frequency band.

Similar to FIGS. 15-17, FIGS. 18 and 19 show examples of co-polarization and cross-polarization measured 3D patterns for two different frequency bands for the dual-band omnidirectional antennas in FIGS. 13 and 14 respectively at 2496 MHz for high band and 912 MHz for lowband.

Figure 20:
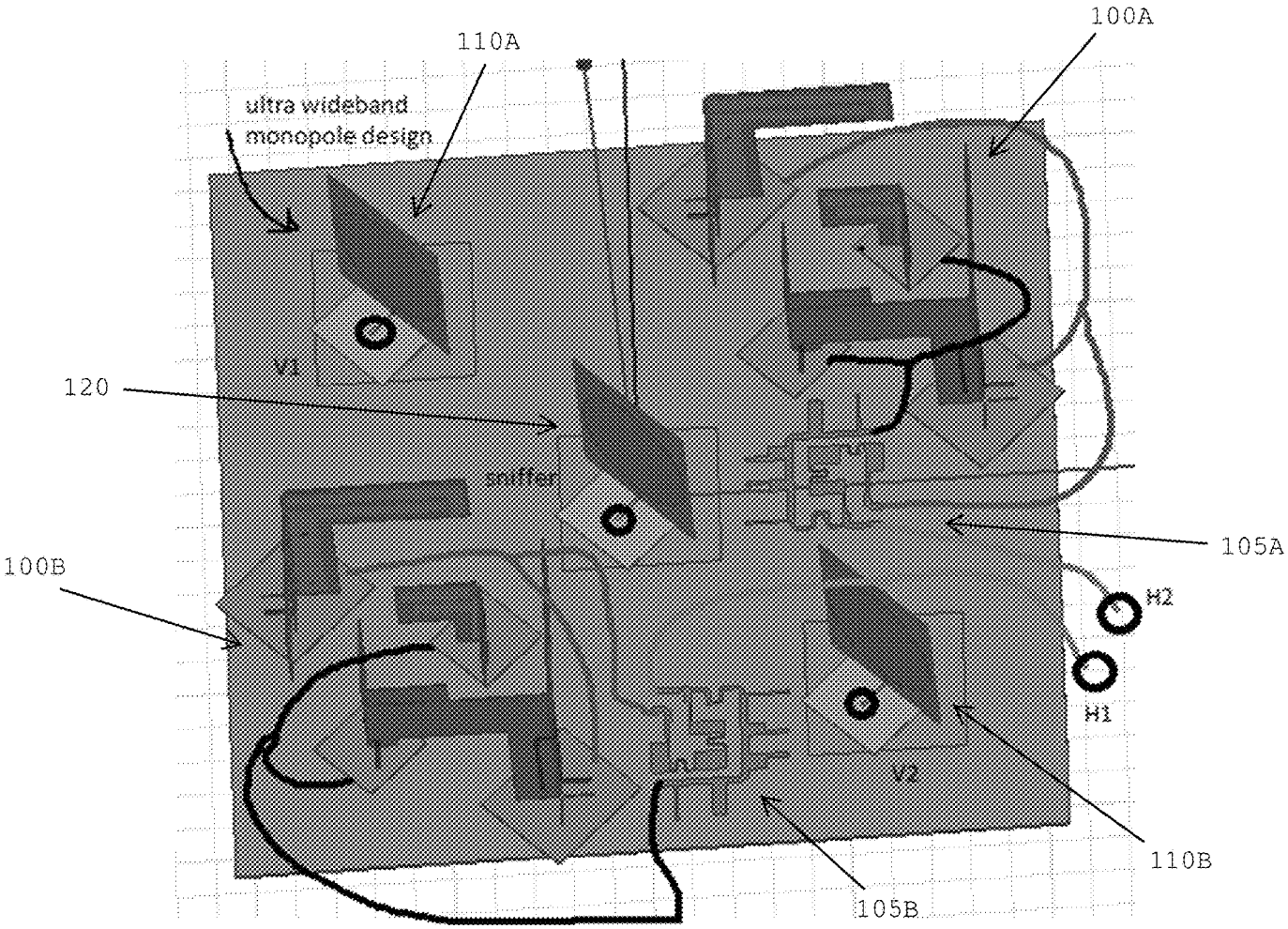
FIG. 20 illustrates a 4*4 MIMO antenna utilizing one aspect of the invention.

It should be noted that aspects of the invention may be used in various antenna configurations. Referring to FIG. 20, one aspect of the invention is illustrated in a MIMO-antenna. The 4*4 MIMO antenna in FIG. 20 has two dualband horizontal polarized omnidirectional antennas 100A, 100B, each being connected to the two ports of a diplexer 105A, 105B to provide two ultra wideband horizontal polarized ports. These horizontal omnidirectional antennas as similar to the antennas illustrated in FIGS. 13 and 14. Also present in FIG. 20 are two ultra wideband monopoles 110A, 110B to provide two vertical polarization ports. The omnidirectional antennas 100A, 100B, in combination with the monopoles 110A, 110B provides an ultra wideband 4*4 MIMO with enough space for a sniffer port 120 in the middle of the assembly.

A person understanding this invention may now conceive of alternative structures and embodiments or variations of the above all of which are intended to fall within the scope of the invention as defined in the claims that follow.

We claim:

1. An indoor antenna comprising:

a first V-shaped dipole having a first arm extending outwardly from a first center of said first dipole and a second arm extending outwardly from said first center;

a second V-shaped dipole having a third arm extending outwardly from a second center of said second dipole and a fourth arm extending outwardly for said second center; wherein said first arm and said second arm define a first angle with a first opening and with said first center being a first vertex of said first angle;

said third arm and said fourth arm define a second angle with a second opening and with said second center being a second vertex of said second angle;

said first and second V-shaped dipoles being constructed and arranged such that said first opening and said second opening face each other, wherein a second dipole center is in 0.3 to 0.7 wavelength of a first dipole center, such that no other similar V-shaped dipole can fit in the two other vertexes of the quadrilateral shaped by the two V-dipoles, wherein said first dipole is fed by a first signal and said second dipole is separately fed by a second signal, such that two separate currents with opposite polarity travel in the corresponding arms of each of said first V-shaped dipole and second V-shaped dipole that are located opposite each other, said first and second V-shaped dipoles together produce horizontally polarized omnidirectional beam pattern with a null in a center direction of a z-axis, when the antenna is located in an x/y plane;

a wideband monopole antenna disposed near said first and second dipole providing a vertically polarized omnidirectional beam pattern, wherein a direction of the wideband monopole antenna is normal to the plane of antenna in the z direction, when the antenna is located in said x/y plane;

said indoor antenna is a horizontally and vertically polarized omnidirectional antenna.

2. The antenna according to claim 1, wherein said first and said second angle are each between 50 and 120 degrees.

3. The antenna according to claim 1, wherein said first and said second angle are equal to one another.

4. The antenna according to claim 1, wherein at least one of said arms is a metallic trace on a printed circuit board.

5. The antenna according to claim 1, wherein said antenna is configured for use with signals having frequencies ranging from 1695 MHz to 2690 MHz.

6. The antenna according to claim 1, wherein said antenna is configured for use with signals having frequencies ranging from 698 MHz to 960 MHz.

7. The antenna according to claim 1, wherein at least one of said first angle and said second angle is 90 degrees.

8. The antenna according to claim 1, wherein a distance between said first vertex and said second vertex is between 60 mm and 160 mm.

9. The antenna according to claim 1, wherein said antenna is for use with signals having a range of frequencies, a distance between said first vertex and said second vertex being based on at least one wavelength of one of said signals.

10. The antenna according to claim 9, wherein said distance is between 0.3 and 0.7 times of said at least one wavelength.

11. The antenna according to claim 1, wherein said first and second dipoles are fed by a splitter using coaxial cables.

12. The antenna according to claim 11, where said splitter is a 3 dB splitter.

13. The antenna according to claim 11, wherein cables used to connect said splitter to said first and second dipoles have equal lengths.

14. An antenna comprising: two assemblies for use as antenna elements, a first assembly being nested inside a second assembly, said second assembly comprising:

a first V-shaped dipole having a first pair of arms, said first pair of arms being in a V-configuration defining a first opening;

a second V-shaped dipole having a second pair of arms, said second pair of arms being in another V-configuration defining a second opening;

wherein said first opening and said second opening are facing each other;

wherein a second dipole center is in 0.3 to 0.7 wavelength of a first dipole center, such that no other similar V-shaped dipole can fit in the two other vertexes of the quadrilateral shaped by the two V-dipoles, wherein said first dipole is fed by a first signal and said second dipole is separately fed by a second signal, such that two separate currents with opposite polarity travel in the corresponding arms of each of said first V-shaped diploe and second V-shaped dipole that are located opposite each other, said first and second V-shaped dipoles together produce horizontally polarized omnidirectional beam pattern with a null in a center direction of a z-axis, when the antenna is located in an x/y plane;

a wideband monopole antenna disposed near said first and second dipole providing a vertically polarized omnidirectional beam pattern, wherein a direction of the wideband monopole antenna is normal to the plane of antenna in the z direction, when the antenna is located in said x/y plane;

said first assembly is located between said first opening and said second opening.

15. The antenna according to claim 14, wherein said second assembly is configured for use with a low frequency band of signals.

16. The antenna according to claim 14, wherein said first assembly is configured for use with a high frequency band of signals.

17. The antenna according to claim 14, wherein said first assembly comprises two dipoles facing each other, each of said two dipoles being in a V-configuration.

18. A 4×4 MIMO antenna comprising:

a first and a second dual band horizontally polarized omnidirectional antenna, wherein each of said first and second dual band omnidirectional antenna further comprises:

an antenna operating at a first frequency band, said antenna comprising:

a first V-shaped dipole having a first arm extending outwardly from a first center of said first dipole and a second arm extending outwardly from said first center;

a second V-shaped dipole having a third arm extending outwardly from a second center of said second dipole and a fourth arm extending outwardly for said second center; wherein said first arm and said second arm define a first angle with a first opening and with said first center being a first vertex of said first angle;

said third arm and said fourth arm define a second angle with a second opening and with said second center being a second vertex of said second angle;

said first and second V-shaped dipoles being constructed and arranged such that said first opening and said second opening face each other, wherein said first dipole is fed by a first signal and said second dipole is fed by a second signal, said first and said second signal are directed through two ports of a corresponding diplexer, such that currents with opposite polarity travel in the corresponding arms of each of said first and second dipole that are located opposite each other said first and second dipole produce horizontally polarized omnidirectional beam pattern;

an antenna operating in a second frequency band, said antenna nested in said antenna operating in a first frequency band further comprising:

a first V-shaped dipole having a first arm extending outwardly from a first center of said first dipole and a second arm extending outwardly from said first center;

a second V-shaped dipole having a third arm extending outwardly from a second center of said second dipole and a fourth arm extending outwardly for said second center;

wherein said first arm and said second arm define a first angle with a first opening and with said first center being a first vertex of said first angle;

said third arm and said fourth arm define a second angle with a second opening and with said second center being a second vertex of said second angle;

said first and second V-shaped dipoles being constructed and arranged such that said first opening and said second opening face each other, wherein said first dipole is fed by a first signal and said second dipole is fed by a second signal, said first and said second signal are directed through two ports of a corresponding diplexer, such that currents with opposite polarity travel in the corresponding arms of each of said first and second dipole that are located opposite each other said first and second dipole produce horizontally polarized omnidirectional beam pattern;

a first and second wideband monopole antenna each of said monopole antennas disposed near said first and second nested dipoles providing a vertically polarized omnidirectional beam pattern;

said 4×4 MIMO antenna is a horizontally and vertically polarized omnidirectional antenna.

19. The dual band 4×4 MIMO antenna of claim 18 wherein said first frequency band operates in a range of 1695-2690 MHz and said second frequency band operates in a range of 698-960 MHz.

* * * * *